US006464549B2

(12) United States Patent
Buzzi

(10) Patent No.: US 6,464,549 B2
(45) Date of Patent: Oct. 15, 2002

(54) BOTTOM ASSEMBLY FOR SURFACE PROPELLER PROPULSION SYSTEMS

(75) Inventor: Fabio Buzzi, Oggiono (IT)

(73) Assignee: FB Design S.r.l., Annone Brianza (IT)

( * ) Notice: Subject to any disclaimer, the term of this patent is extended or adjusted under 35 U.S.C. 154(b) by 0 days.

(21) Appl. No.: 09/767,942

(22) Filed: Jan. 24, 2001

(65) Prior Publication Data

US 2002/0025736 A1 Feb. 28, 2002

(30) Foreign Application Priority Data

Aug. 23, 2000 (IT) ..... MI2000A001898

(51) Int. Cl.[7] ..... B63H 5/16
(52) U.S. Cl. ..... 440/66; 440/68
(58) Field of Search ..... 440/66, 68, 69, 440/70; 114/55.57

(56) References Cited

U.S. PATENT DOCUMENTS 3,793,980 A * 2/1974 Sherman ..... 440/69
4,231,315 A * 11/1980 Tachibana et al. ..... 114/121
4,941,423 A * 7/1990 Van Tassel ..... 114/289

* cited by examiner

*Primary Examiner*—Sherman Basinger
(74) *Attorney, Agent, or Firm*—Millen, White, Zelano & Branigan, P.C.

(57) ABSTRACT

A bottom assembly for motor boats is described, of the type including at least one longitudinal tunnel, through which passes a propeller shaft exiting from the bottom, wherein there is provided at least one ground wall to close, totally or partially, the tunnel and limit the entry of water into the same during boat advancement.

19 Claims, 4 Drawing Sheets

BOTTOM ASSEMBLY FOR SURFACE PROPELLER PROPULSION SYSTEMS

FIELD OF THE INVENTION

The present invention concerns a bottom assembly suitable for producing a motor boat with a so-called "surface propeller" type of propulsion system.

BACKGROUND OF THE INVENTION

Surface propeller type propulsion systems have been known for some time, in which the propeller is partially immersed in the water and therefore works only with its lower part. The hub and the support member of the propeller, in addition to the propeller shaft providing movement to the same, stay out of the water also during hull movement, so as to reduce resistance caused by friction of the appendices.

Compared to the immersed propeller propulsion systems, the surface propeller propulsion systems have a particularly reduced axis inclination. However if, on the one hand, it gives greater efficiency to the propulsion system, on the other hand it results in increased longitudinal hull dimensions.

To obviate this drawback, use has been made of the so-called tunnels, i.e. the recesses made at the base of the bottom which extend longitudinally in the stern portion of the hull. Each tunnel (one for each propeller shaft exiting from the bottom) consists of one or more walls that surround sideways and above the propeller shaft exiting from the bottom. Until now, tunnels have been adopted both with conventional transmission types, in which the kinematic chain is longitudinally aligned from the motor to the propeller, as well as with V-drive transmission types, in which the motor is situated at the stern, in a particularly set back position, above the propeller shaft.

However, the tunnel solution creates another problem. In fact, the presence of one or more tunnels alters the bottom by reducing its original hydrodynamic lift and giving rise to an increase in the hydrostatic pressure on the bottom itself. Consequently, under certain hull speed conditions, each tunnel tends to fill up with water during hull advancement and therefore the propeller is no longer able to work properly at the surface.

Moreover, in certain rough conditions of the surrounding water, each tunnel tends to fill up with water in a variable and often irregular way, thus compromising the efficiency of the surface propeller propulsion. These drawbacks are particularly marked with "V-drive" transmission types which have a particularly set back barycenter.

SUMMARY OF THE INVENTION

The object of the present invention is to provide a bottom assembly equipped with one or more tunnels that allows the correct operation of the propulsion systems, particularly of the surface propeller types. Another object of the present invention is to provide a bottom assembly equipped with one or more funnels that confers the maximum efficiency to the surface propeller propulsion system independently of the boat speed conditions and/or the rough conditions of the surrounding water.

These objects are achieved by the present invention, that concerns a bottom assembly for motor boats, of the type comprising at least one longitudinal tunnel arranged at least at the stern portion of the bottom, the tunnel including one or more walls that surround, above and sideways, at least one propeller shaft exiting from the bottom to rotationally operate at least one propeller, characterised in that it includes at least one ground wall radiused to the surface of the bottom to close, at least partially, the cited at least one tunnel and limit the entry of water into the same.

This allows absolute minimisation of the loss of original hydrodynamic lift caused by the presence of one or more tunnels. Consequently, the propeller situated at each tunnel exit can work correctly at the surface, independently of the conditions of boat speed or wave motion around it.

According to a possible embodiment of the present invention, the ground wall is made of a closing member applied to the bottom. In this case, the tunnel is used during construction to help in the assembling phase of the various seal and/or support members for the propeller shaft, and thus is covered by the closing member. A considerable practical advantage of this solution is that it is also particularly simple to apply to already existing bottoms.

A bottom assembly made according to the present invention can include a hollow seat that surrounds each tunnel to allow the fixing of the closing member, hence maintaining the external surface continuity between the bottom and the closing member itself.

According to another possible embodiment, the tunnel and the relative ground wall are integrally made in the bottom. This solution can be suitable, for instance, for hulls of metal construction, or anyway in the cases in which it would be possible to assemble the support and/or seal members for the propeller shaft also with the tunnel substantially closed on the bottom.

According to another aspect of the present invention, the ground wall can include a suitably shaped end, or of reduced size, turned towards the propeller. The particular shape of the end portion, e.g. obtained by making a cut, may prove necessary to obtain optimum performance depending on the cavitation characteristics of the propeller exiting from the tunnel.

BRIEF DESCRIPTION OF THE DRAWINGS

Additional characteristics and advantages of the present invention will become apparent from the following description, with reference to the attached drawings, in which.

DETAILED DESCRIPTION

Figure 1:
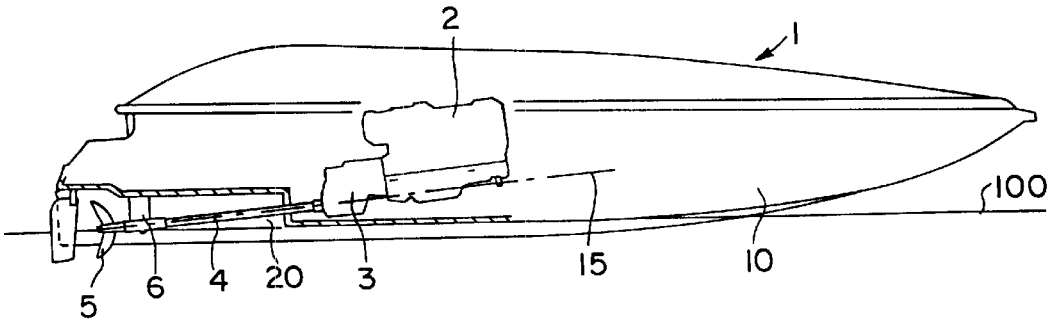
FIG. 1 PRIOR ART
FIG. 1 is a longitudinal section view of a motor boat equipped with tunnels according to the known technique.
Figure 2:
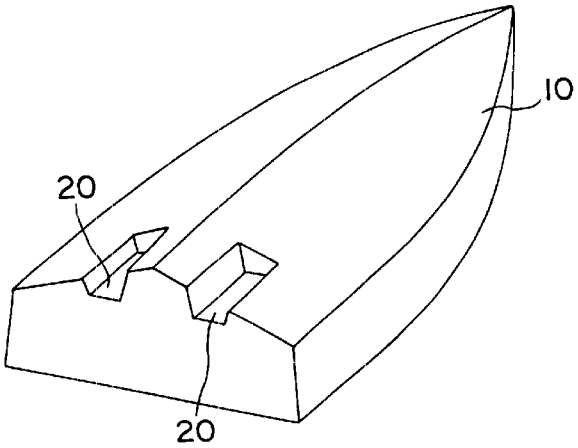
FIG. 2 PRIOR ART
FIG. 2 is a perspective view of a bottom according to the known technique in a reversed position.
Figure 3:
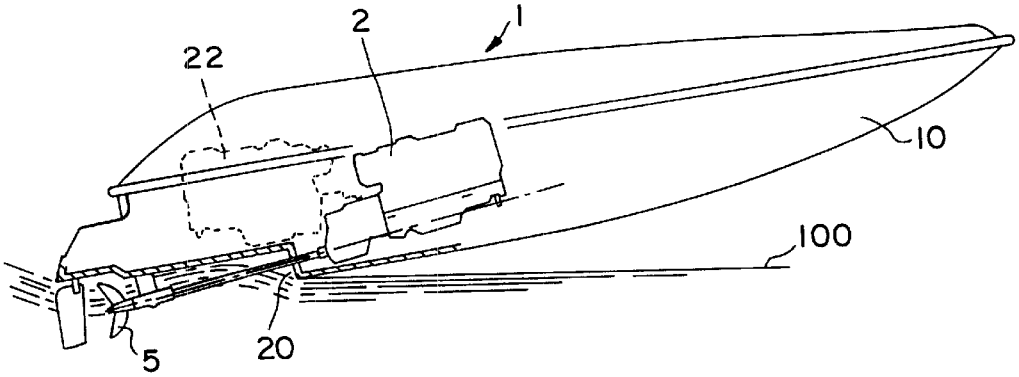
FIG. 3 PRIOR ART
FIG. 3 is a longitudinal section view that illustrates the behaviour of a motor boat, according to the known technique, during advancement in water.

FIGS. 1 to 3 illustrate some views of motor boats 1 equipped with surface propeller propulsion systems with bottoms made according to the known technique. For instance, the bottoms can be made with reinforced resins or similar by means of injection moulding procedures. The propulsion system of the motor boat 1 in general includes a motor unit 2, a reversing gearbox 3, a propeller shaft 4 and a propeller 5, near which is envisaged a support member 6 (fixed to the bottom 10) for the propeller shaft 4.

To limit the inclination of the propeller axis 15 in relation to the water surface 100, the propeller shaft 4 exiting from bottom 10 is housed in a tunnel 20, the latter having one or more walls that surround, sideways and above, the propeller shaft 4. The support member 6 for the propeller shaft 4 can also be housed, if necessary, also just partially in tunnel 20.

For each propeller shaft 4 exiting from the bottom 10, a tunnel 20 is envisaged substantially set in the stern portion of the same bottom. The bottom 10 shown as an example in FIG. 2 is prepared with two tunnels 20, each to house a respective propeller shaft 4.

FIG. 3 represents the behaviour of the motor boat 1 of FIG. 1 during its advancement in water. As can be seen, the modification of the bottom 10 set by the presence of a tunnel 20 involves a variation in the original lift of the same bottom. This results in an increase in the hydrostatic pressure on the bottom 10 that promotes the tunnel 20 to fill with water, with the result that the propeller 5 is no longer able to work properly at the surface.

This phenomenon is even more marked if the motor boat 1 adopts a "V-drive type" propulsion system, in which the motor 22 (shown by the dotted line in FIG. 3) occupies a more set back position compared to a motor 2 of a conventional type of propulsion system.

Figure 4:
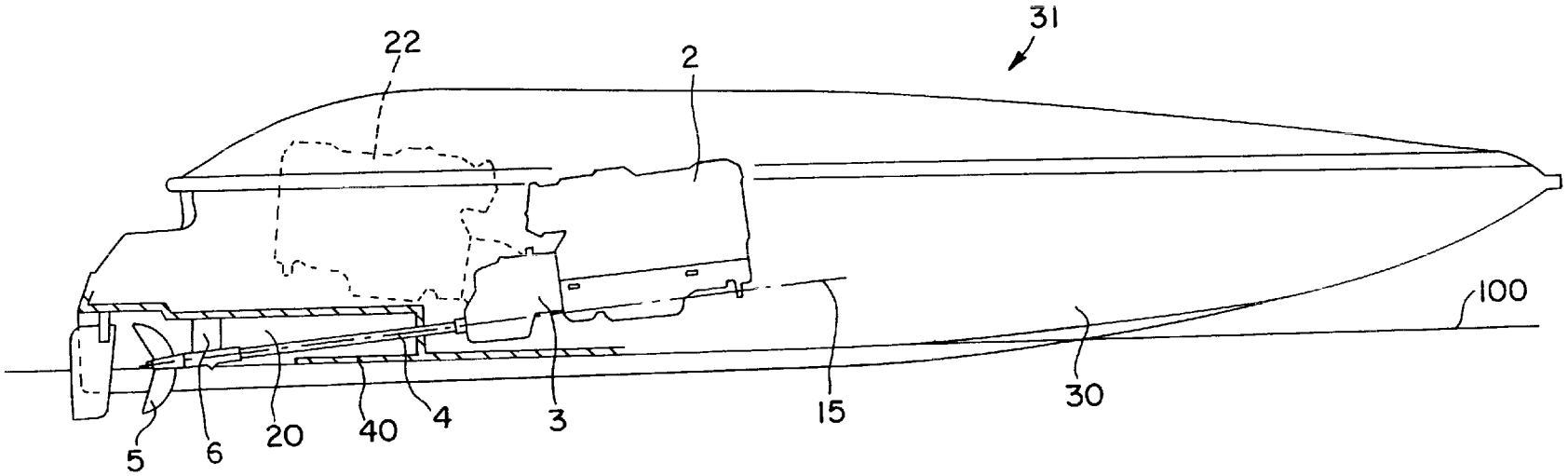
FIG. 4 is a longitudinal section view of a motor boat equipped with a bottom assembly according to the present invention.

To obviate these drawbacks the present invention proposes a motor boat 31 like that shown in FIG. 4, which retains the same reference numbers that identify the substantially unchanged parts as regards those already identified in the previous FIGS. 1–3.

According to the present invention, a bottom assembly 30 is always equipped with a tunnel 20, but a ground wall 40 is envisaged, radiused to the bottom surface 30, allowing at least the partial closure of the tunnel 20 so as to restore, as much as possible, the original bottom lift and thus limit the entry of water into the same tunnel.

Once the motor boat 31 has reached the correct planing trim, the tunnel 20 by that time has already dynamically emptied itself of water and the ground wall 40 prevents the entry of water into the tunnel during the advancement of the same hull. This has the advantage of maintaining a constant performance of the boat, independently of its speed and rough conditions of the surrounding water.

A bottom assembly made according to the present invention can be identically adopted in the boats with conventional propulsion systems, in which the kinematic chain is aligned in sequence from the motor unit 2 until the propeller 5, as in boats with "V-drive" type propulsion systems, in which the motor 22 (also here shown by a dotted line) occupies a more set back stern position.

Figure 5:
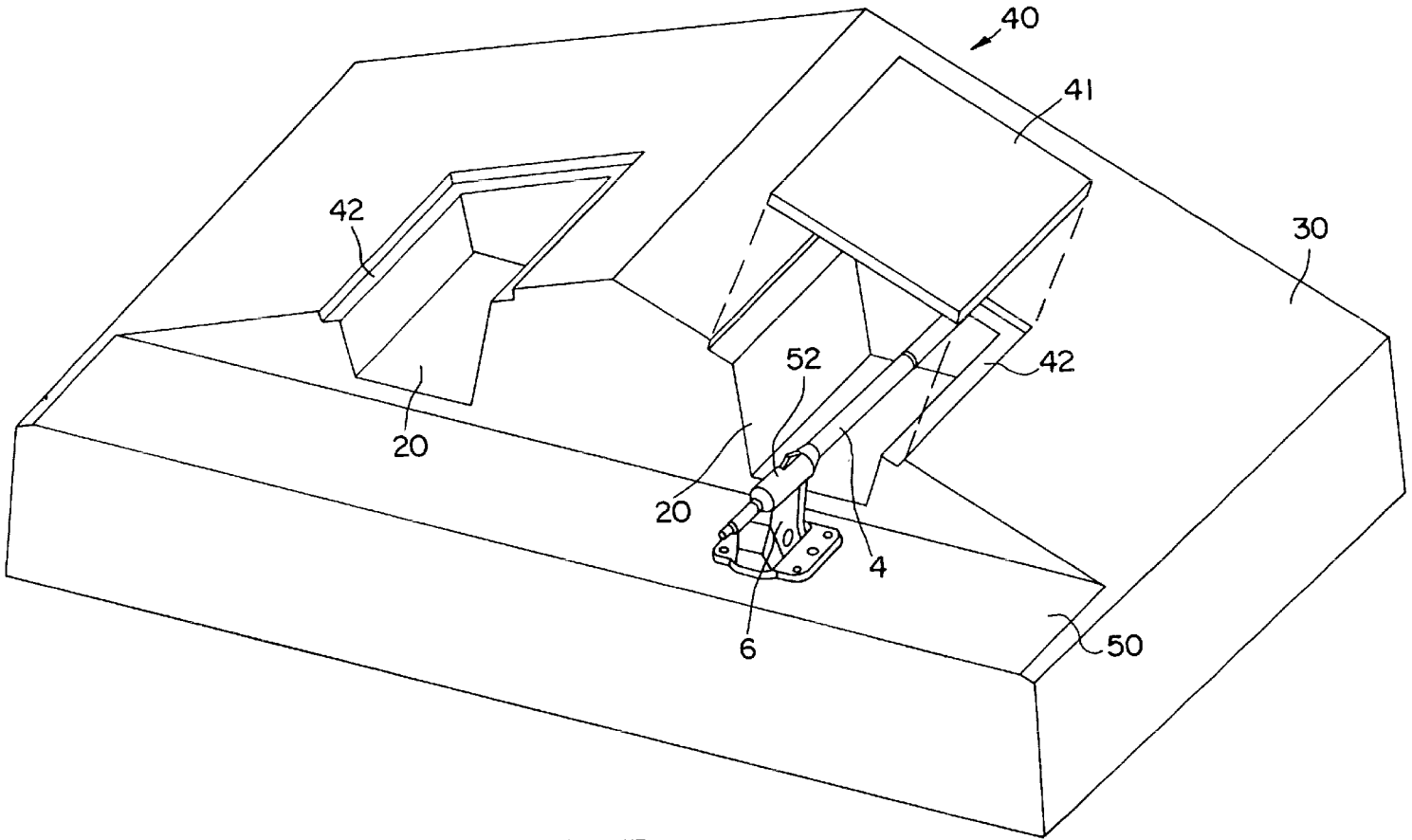
FIG. 5 is a view of the stern portion of a bottom, according to a possible embodiment of the present invention, in a reversed position.

FIG. 5 illustrates a possible embodiment of the invention, according to which the ground wall 40 of the bottom assembly 30 is realized by a closing member 41 that is applied to the bottom itself.

For simplicity, a closing member 41 is outlined in the form of a substantially flat plate, but it should to understood that the closing member 41 can also take on a slightly bent or shaped form according the bottom shape to be restored at the tunnel 20. In addition, although just one closing member 41 is shown for simplicity, it is also appropriate to point out that all the tunnels 20 in the bottom 30 (both tunnels 20 in the case shown) must be closed with a respective closing member 41.

The closing member 41 is preferably fixed to the bottom 30 so as to maintain the external surface continuity between the bottom 30 and the closing member 41. For this purpose a hollow seat 42 is envisaged that surrounds the tunnel 20 to receive the closing member 41. In the case of hulls produced by injection moulding, the seats 42 are easily obtained during injection moulding by suitable inserts set around the protruding templates designed to produce the tunnels 20.

Each tunnel 20 can therefore be used to help with the assembly of the transmission parts that protrude from the bottom 30, i.e. the propeller shaft 4, the relative support 6 and a sealing element (not shown in FIG. 5). After assembly, the tunnel 20 can be closed, also just partially, to restore as much as possible the original configuration of the bottom 30.

This embodiment is in any case adaptable in a particularly simple way also to already existing hulls of known type. In this case, the closing member can, for instance, have protruding portions or appendices that allow it to be fixed at the tunnel walls, or anyhow in any other suitable point which ensures particularly secure fixing.

Figure 6:
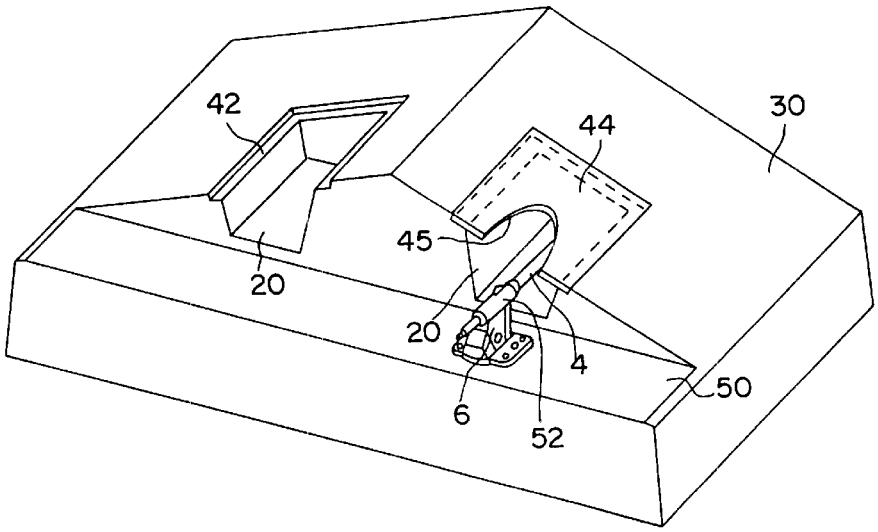
FIG. 6 is a view of the stern portion of a bottom, according to another possible embodiment of the present invention, in a reversed position.

In the embodiment of FIG. 6, a closing member 44 can be suitably shaped, e.g. by cutting out part of it along a line 45, at its end portion turned towards the propeller (not shown in FIG. 6). The shape or the reduction of the end portion is made depending on the cavitation characteristics of the propeller and can also therefore take on different forms to that shown as an example.

Figure 7:
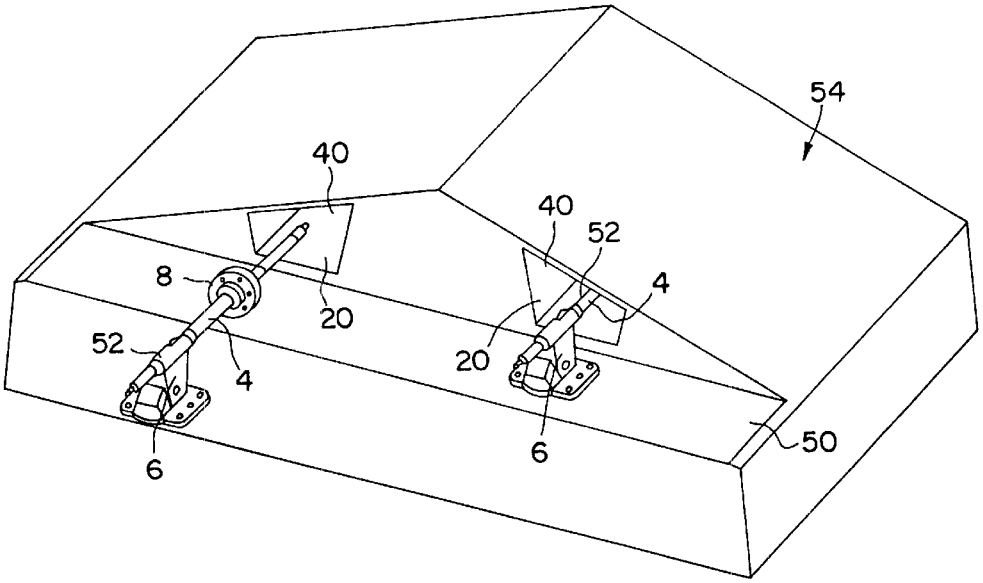
FIG. 7 is a view of the stern portion of a bottom, according to an additional possible embodiment of the present invention, in a reversed position.

FIG. 7 shows an embodiment of a bottom assembly 54 in which the ground walls 40 of the tunnels 20 can be integrally made in the same bottom. This embodiment can be suitable, for instance, for metal hulls, or in any case, hulls for which it is possible to assemble, from the rear, the transmission members shown in FIG. 7, especially at least the propeller shaft 4 and the seal and thrust bearing 8, in addition to the possible support member 6 in the case in which it is to be assembled (differently from that represented in FIG. 6) also only partially inside the tunnel 20.

Also in this case, the ground wall 40 can be suitably shaped near the propeller, as already explained for the closing member 44 in the embodiment of FIG. 6.

In FIGS. 5, 6 and 7 the propeller is mounted beneath a step 50 with the support member 6 extending from the step to the propeller shaft 4. The boss 52 on the strut 6 supporting the propeller shaft 4 is substantially outside of the tunnel 20 and out from beneath the ground wall 40 in FIGS. 5, 6 and 7.

What is claimed is:

1. A bottom assembly for motor boats having a stern portion, at least one engine, a propeller shaft extending from the engine and a propeller mounted on the propeller shaft, comprising:

at least one longitudinal tunnel located adjacent to the stern portion of the bottom assembly, said tunnel including walls that surround the propeller shaft, one of the walls being a ground wall radiused to the surface of the bottom, to limit entry of water into the tunnel, the tunnel having only a single opening in the form of an open end proximate the stern through which the propeller shaft extends, the propeller being positioned outside of the tunnel, whereby the tunnel remains substantially free of water when the motor boat is underway at planing speed with the propeller partially immersed in the water over which the boat is proceeding.

2. A bottom assembly according to claim 1, wherein said ground wall is made using a closing member applied to said bottom.

3. A bottom assembly according to claim 2, wherein said bottom includes at least one hollow seat that surrounds said at least one tunnel to receive said closing member maintaining the external surface continuity between said bottom and said closing member.

4. A bottom assembly according to claim 1, wherein said tunnel and said ground wall are integrally made in said bottom.

5. A bottom assembly according to claim 1, wherein said ground wall includes a suitably shaped end, or of reduced size, turned towards the propeller.

6. A bottom assembly according to claim 1, wherein said bottom includes at least one hollow seat that surrounds said at least one tunnel to receive said ground wall maintaining the external surface continuity between said bottom and said ground wall.

7. A bottom assembly according to claim 6, wherein the ground wall includes a shaped end having a reduced portion adjacent to the propeller.

8. A bottom for motor boats, comprising:

at least one longitudinal tunnel located at a stern portion of the bottom, the tunnel including walls surrounding a propeller shaft exiting from the bottom to rotationally operate a propeller, the tunnel including a ground wall radiused to the surface of the bottom to close a portion of the tunnel upstream of the propeller, to limit entry of water into the tunnel, the tunnel having only a single opening in the form of an open end proximate the stern through which the propeller shaft extends, the propeller being positioned outside of the tunnel, whereby the tunnel remains substantially free of water when the motor boat is underway at planing speed with the propeller partially immersed in the water over which the boat is proceeding.

9. A bottom according to claim 8, wherein the ground wall is a separate closing member applied over the tunnel so as to be integral with the bottom.

10. A bottom according to claim 9, wherein the bottom includes at least one hollow seat that surrounds the tunnel to receive the closing member so as to maintain external surface continuity between the bottom and the closing member.

11. The bottom assembly of claim 1 in combination with a motor boat wherein in at least one engine of the motor boat is positioned forward of the associated propeller shaft.

12. The bottom assembly of claim 11 wherein the propeller is positioned beneath a step formed in the bottom outside of the tunnel.

13. The bottom assembly of claim 12 wherein a support strut extends from the step to the propeller shaft between the propeller and the open end of the tunnel.

14. The bottom assembly of claim 13 wherein the motor boat includes two engines, two drive shafts and two propellers, and the bottom assembly includes two tunnels.

15. The bottom assembly of claim 1 in combination with a motor boat wherein at least one engine is positioned above the associated propeller shaft and is connected to the propeller shaft by a V-drive.

16. The bottom assembly of claim 15 wherein the propeller is positioned beneath a step formed in the bottom outside of the tunnel.

17. The bottom assembly of claim 16 wherein a support strut extends from the step to the propeller shaft between the propeller and the open end of the tunnel.

18. The bottom assembly of claim 17 wherein the motor boat includes two engines, two drive shafts and two propellers, and the bottom assembly includes two tunnels.

19. The bottom assembly of claim 1 further comprising a step outside of the tunnel and above the propeller to which the propeller shaft is attached by a strut.

* * * * *